United States Patent [19]

Shimomura

[11] Patent Number: 4,859,164

[45] Date of Patent: Aug. 22, 1989

[54] FERROUS SINTERED ALLOY VANE AND ROTARY COMPRESSOR

[75] Inventor: Soichi Shimomura, Yono, Japan

[73] Assignee: Nippon Piston Ring Co., Ltd., Tokyo, Japan

[21] Appl. No.: 125,324

[22] Filed: Nov. 25, 1987

[30] Foreign Application Priority Data

Dec. 6, 1986 [JP] Japan ..... 61-291364

[51] Int. Cl.[4] ..... F03C 2/00

[52] U.S. Cl. ..... 418/179; 29/156.8 B; 29/156.8 R; 419/25

[58] Field of Search ..... 29/156.8 B, 156.8 R; 419/25; 418/63, 179; 148/11.5 P, 125

[56] References Cited

U.S. PATENT DOCUMENTS

| | | | |
|---|---|---|---|
| 2,757,446 | 8/1956 | Boegehold et al. | 29/156.8 B |
| 2,958,617 | 11/1960 | Perry | 148/125 |
| 3,152,934 | 10/1964 | Lula et al. | 148/125 |
| 3,185,600 | 5/1965 | Dullberg | 148/125 |
| 3,223,562 | 12/1965 | Bassett, III | 148/125 |
| 3,336,169 | 8/1967 | Kihlberg et al. | 148/125 |
| 3,413,166 | 11/1968 | Zackay et al. | 148/125 |
| 3,888,663 | 6/1975 | Reichman | 29/156.8 B |
| 4,101,712 | 7/1978 | Bomford et al. | 29/156.8 B |
| 4,490,175 | 12/1984 | Matsuzaki | 418/179 |
| 4,618,317 | 10/1986 | Matsuzaki | 418/179 |

OTHER PUBLICATIONS

Japanese Laid Open Patent Publication No. 56-5955, Jan. 22, 1981.

*Primary Examiner*—Howard N. Goldberg
*Assistant Examiner*—Irene Cuda
*Attorney, Agent, or Firm*—Oliff & Berridge

[57] ABSTRACT

A vane used in a rotary compressor, and rotary compressor including the vane are made from a ferrous sintered alloy. The method comprises the steps of preparing metal powder mixture primarily containing iron, compacting the powder mixture to obtain a powder compact, sintering the powder compact to obtain a sintered body, subjecting sub-zero treatment to the sintered body, and tempering the sintered body. The sintered alloy product is used as a vane slidably disposed in a vane groove of the rotary compressor whose cooling medium is maintainable without deterioration of its property.

5 Claims, 2 Drawing Sheets

FERROUS SINTERED ALLOY VANE AND ROTARY COMPRESSOR

BACKGROUND OF THE INVENTION

The present invention relates to a method for producing a ferrous sintered alloy, and to a ferrous sintered alloy product applied to a vane used in a rotary compressor available for an air conditioner and an air cooling device.

A structure of an ordinary rotary compressor provided with an eccentric rotor is shown in FIG. 1. In FIG. 1, a rotor housing 2 is disposed in a casing 1, and the rotor housing 2 is formed with a vane groove 3 in the radial direction thereof. A vane 4 is disposed slidable with respect to the vane groove 3. In the rotor housing 2, a rotor 5 is rotatably disposed. The rotor 5 is fitted with a crankshaft 6 whose rotation shaft 6*a* is provided coaxial with the rotor housing 2, and whose crank portion 6*b* is disposed eccentrical with respect to the rotation shaft 6*a*. A radially inner end of the vane 4 is in sliding contact with the outer peripheral surface of the rotor 5, and a radially outer end of the vane 4 is connected to a coil spring 9 disposed in a recess 10 of the rotor housing 2. Therefore, the vane 4 is urged radially inwardly by the spring 9, so that the inner end of the vane is in continuous contact with the rotor 5. Upon rotation of the rotor 5, the vane 4 is reciprocally movable along the vane groove 3, and fluid intake and discharge operation is performed. The vane 4 fluid-tightly divides a cavity of the rotor housing 2 into two chambers as shown.

In this connection, the vane 4 must provide sufficient fluid tightness to positively partition the two pressure chambers. Further, the vane 4 must provide high wear resistivity due to sliding contact with the rotating rotor 5.

Recently, there has been produced a vane for use in the rotary compressor made of a sintered alloy formed primarily of ferrous powders so as to obtain a resultant vane having high wear resistance and fluid-tightness. In such a sintered alloy, the alloy generally employed is one in which carbide and other alloy particles are dispersed in a pearlitic matrix or martensitic matrix.

However, a rotary compressor vane formed of the above-described sintered alloy may contain retained austenite in its metal structure upon production thereof. If the retained austenite exists in the sintered alloy vane, the retained austenite is transformed into martensite due to ambient temperature change provided by the frictional sliding motion of the vane relative to the vane groove upon operation of the compressor. This transformation causes a deformation with the passing of time together with expansion of the vane.

This change with time is disadvantagous for the vane assembled in the compressor shown in FIG. 1, since such vane requires extremely high dimensional accuracy and stability.

In order to remove the retained austenite, the sintered alloy is subjected to oil hardening or oil tempering to obtain martensitic structure. However, since the sintered product contains pores or voids, oil accumulated therein may ooze out of the sintered product. If such a sintered product is used as a vane of the rotary compressor, the oil may deteriorate the property of flon gas used as a cooling medium. This oil tempering is disclosed for example, Japanese Patent Application Publication (KoKai) No. 56-5955.

SUMMARY OF THE INVENTION

It is therefore an object of the present invention to overcome the above-described drawbacks and disadvantages, and to provide an improved method for producing ferrous sintered alloy and to provide the sintered alloy product available for a vane in a rotary compressor.

Another object of the present invention is to provide a method which can produce a ferrous sintered alloy product having excellent wear resistivity and fluid-tightness.

Still another object of this invention is to provide a ferrous sintered alloy product produced at low cost with high productivity.

Still another object of this invention is to provide a ferrous sintered alloy product free from oil oozing therefrom when it is used as a vane of a rotary compressor.

These and other objects of the present invention will be attained by performing sub-zero treatment to a sintered body and then tempering the sintered body. Briefly, and in accordance with a method of the present invention, metal powder mixture mainly containing iron is initially compacted, and the powder compact is sintered. Thereafter, the sintered body is subjected to sub-zero treatment, and then subjected to tempering.

By the sub-zero treatment, retained austenite in the sintered body can be transformed into martensite. As a result, deformation of the product with time can be eliminated. Further, since no oil is employed for hardening during production steps, property of the flon gas used in the compressor can be maintained without any affect from the oil.

DETAILED DESCRIPTION OF THE INVENTION

Refering now to an embodiment of the present invention, powders having the following compositions were prepared (the percentages are all percent by weight):

| | |
|---|---|
| C: | 0.8–1.5% |
| Ni: | 0.5–2.0% |
| Cr: | 5.0–10.0% |
| Mo: | 0.8–2.0% |
| Fe: | balance |

The above described compositions are prepared by mixing together atomized SUS system powders (SUS is stainless steel defined by Japanese Industrial Standard, JIS G4301), low alloy steel powders, Ni powders, Mo powders, and C powders. SUS system is, for example, martensitic system SUS 403 or SUS 410, and low alloy steel powders include components other than Fe such as, for example, not more than 3% of Cr, not more than 3% of Mo, not more than 3% of Ni, and the balance Fe. The term "low" implies relatively small amounts of metals other than Fe such as Cr, Mo and Ni.

More specifically, the powder mixture contains 1.3% by weight of C, 0.8 wt% of Ni, 7.0 wt% of Cr, 1.2 wt% of Mo, and the balance Fe and impurities. Zinc stearate is added as a lubricant into the powder mixture, and the mixture is compacted at a compacting pressure of 6 ton/cm$^2$. Then the powder compact is sintered at a temperature ranging from 1100° to 1200° C. in ammonia decomposed gas. Thereafter, the sintered body is subjected to sub-zero treatment at a temperature of not more than −100° C., and then the product is tempered at a temperature of not less than 200° C. Resultant product is subjected to final machining to obtain a ferrous sintered alloy product.

Generally, sub-zero treatment is performed by dipping a steel product into liquid nitrogen or dry ice immediately after hardening of the steel product. Inventive feature of this invention resides in sub-zero treatment to the sintered body so as to eliminate austenitic structure in the alloy structure.

Figure 4:
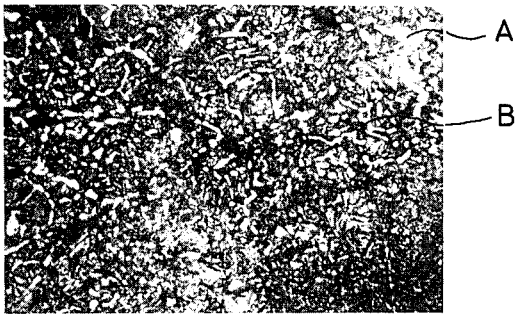
FIG. 4 is a microscopic photograph showing an alloy structure after sub-zero treatment; and, FIG. 5 is a microscopic photograph showing an alloy structure prior to sub-zero treatment.
Figure 5:
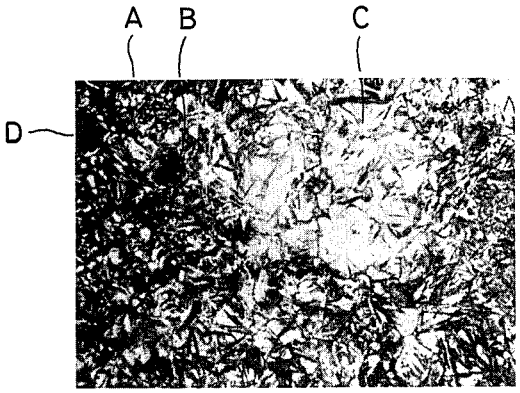

Further, the above-described compositions per se have been described in Japanese Patent Application Publication (Kokai) No. 56-5955. Here, the most ideal way is to find out optimum compositions which do not provide retained austenite after sintering. However, it would be rather difficult and time consuming to investigate such compositions. Rather, in the present invention, known compositions are used, which inherently provide some technical advantages as described in the Publication, and drawbacks attendant thereto, i.e., existence of retained austenite in the sintered alloy, have been overcome by the application of sub-zero treatment to the sintered body. Condition of the sub-zero treatment is dependent on the shape and dimension of the sintered body. However, the sub-zero treatment should be conducted at a temperature not more than −80° C. so as to transform the retained austenite into martensite. As is apparent from FIG. 4 (400 magnifications), in the ferrous sintered alloy subjected to the sub-zero treatment, minute carbides (composite carbide comprising Fe-C-Cr system) are primarily dispersed in tempered martensitic matrix without retained austenite. In FIG. 4, white portions A and black portions B designate carbide and martensite, respectively. On the other hand, the retained austenite C remains in the sintered alloy body subjected to no sub-zero treatment as shown in FIG. 5 (400 magnifications), wherein small white areas A designate carbide, black portions B designate martensite and grey portions D designate bainite.

The tempering performed at the final step of this invention serves to absorb any deformation or strain in the sintered product, which deformation being generated at the sub-zero treatment step.

Figure 3:
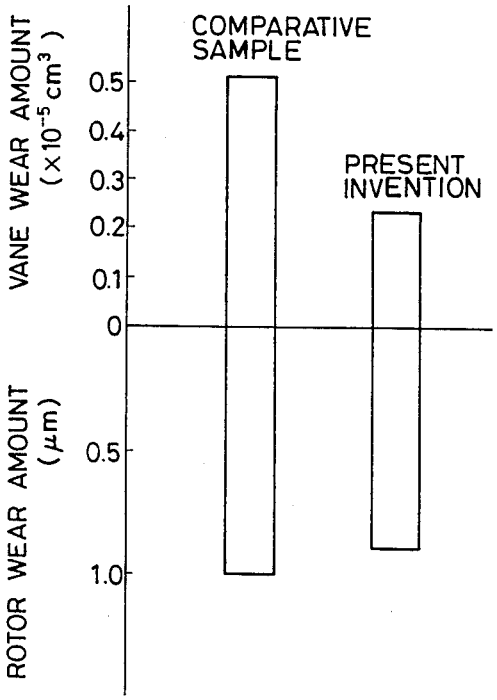
FIG. 3 is a graphical representation showing results of the wear resistance test of FIG. 2.

In order to investigate superiority of the present invention, two kinds of test pieces were prepared, one being a sintered product subjected to sub-zero treatment and tempering, and the other being a sintered product subjected to no sub-zero treatment. Compositions of the sintered bodies were the same as those described above, and structure of the sintered bodies contained bainite, martensite and retained austenite (see FIG. 5). For testing wear resistivity in the ferrous sintered product according to the present invention and that of the comparative test piece, these test pieces 7 (corresponding to the vane member) were stationarily mounted on a rotary piece 8 (corresponding to the rotor) formed of Ni-Cr-Mo cast iron. The stationary piece 7 was urged toward the rotary piece 8 with supplying lubricant therebetween for testing wear amount. Testing conditions were as follows:

Load applied to the test piece: 40 kg
Peripheral speed of the rotary piece: 1.5 m/sec.
Lubricant: freezing machine oil (equivallent to ISO 56)
Oil amount: 0.3 liters/min.
Temperature: room temperature
Testing period: 3 hours Test results are shown in FIG. 3. As is apparent from FIG. 3, the sintered alloy product produced by the method of the present invention provides excellent wear resistivity with reduced wear amount in comparison with the comparative piece wherein no sub-zero treatment was performed.

Figure 1:
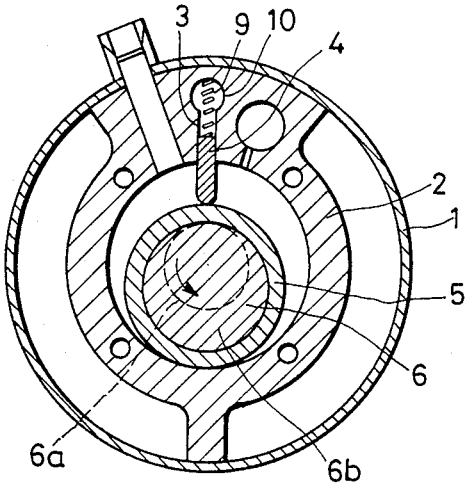
FIG. 1 is a cross-sectional view showing a rotary compressor having a vane.
Figure 2:
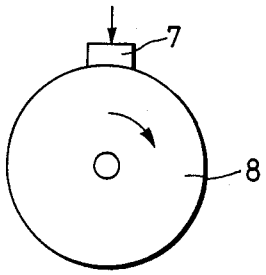
FIG. 2 is an explanatory illustration showing a wear resistance test of a sintered product.

Further, the comparative test piece was expanded by not less than 5 micron meters due to deformation with time when the piece was assembled and used in the rotary compressor shown in FIG. 1. Therefore, the comparative piece is not available as the vane member which requires high dimensional accuracy and stability, as generally not more than 5 μm tolerable clearance between the vane and the vane groove is required.

The ferrous sintered alloy product produced in accordance with the method of this invention is particularly available as vanes for use in the rotary compressor installed in an air conditioner and an air cooling device. However, the alloy product is also available for various sintered mechanical parts which required high wear resistance, fluid-tightness and dimensional accuracy.

As described above, according to the present invention, the resultant sintered product provides excellent wear resistivity and high dimension accuracy and stability as well as high productivity.

While the invention has been described in detail and with reference to specific embodiment thereof, it will be apparent for those skilled in the art that various changes and modifications can be made therein without departing from the spirit and scope of the invention.

What is claimed is:

1. A vane for use in a rotary compressor employing a cooling medium, said vane comprising a ferrous sintered alloy product produced by the steps of:
   - preparing metal powder mixture primarily containing iron;
   - compacting said powder mixture to obtain a powder compact;
   - sintering said powder compact to obtain a sintered body;
   - subjecting sub-zero treatment to said sintered body;
   - tempering said sub-zero treated sintered body; and
   - machining said sintered body, whereby said cooling medium is maintained without deterioration of its property upon operation of said rotary compressor.

2. A vane for use in a rotary compressor as claimed in claim 1, wherein said metal powder mixture comprises 0.8–1.5% by weight of carbon, 0.5–2.0% by weight of nickel, 5.0–10.0% by weight of chromium, 0.8–2.0% by weight molybdenum and the balance iron.

3. A rotary compressor comprising:
   - a casing;
   - a rotor housing disposed in said casing and formed with a groove;

a rotor eccentrically rotatable in said rotor housing;

a vane disposed slidable relative to said groove and in sliding contact with said rotor, said vane being formed of a ferrous sintered alloy which is subjected to sub-zero treatment after sintering and prior to tempering.

4. A rotary compressor as claimed in claim 3, wherein said ferrous sintered alloy is produced by the steps of:

preparing a metal powder mixture primarily containing iron;

compacting said powder mixture to obtain a powder compact;

sintering said powder compact to obtain a sintered body;

subjecting said sintered body to sub-zero treatment;

tempering said sub-zero treated sintered body; and machining said sintered body whereby a cooling medium is maintained without deterioration of its properties upon operation of said rotary compressor.

5. A rotary compressor as claimed in claim 4, wherein said metal powder mixture comprises 0.8–1.3% by weight of carbon, 0.5–2.0% by weight of nickel, 5.0–10.0% by weight of chrominum, 0.8–2.0% by weight molybdenum and the balance iron.

* * * * *